US007498506B2

(12) United States Patent
Nakagawa

(10) Patent No.: US 7,498,506 B2
(45) Date of Patent: Mar. 3, 2009

(54) FOOT VOLUME PEDAL SYSTEMS AND METHODS

(75) Inventor: Shuichi Nakagawa, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 11/527,910

(22) Filed: Sep. 27, 2006

(65) Prior Publication Data

US 2007/0074623 A1 Apr. 5, 2007

(30) Foreign Application Priority Data

Sep. 30, 2005 (JP) ..... 2005-286178

(51) Int. Cl.
*G10H 3/00* (2006.01)

(52) U.S. Cl. ..... 84/746; 84/229; 84/353; 84/357; 84/743

(58) Field of Classification Search ..... 84/229, 84/353, 357, 422.1, 422.2, 422.3, 743, 746
See application file for complete search history.

(56) References Cited

U.S. PATENT DOCUMENTS 4,782,733 A * 11/1988 Herring ..... 84/422.1
4,817,485 A * 4/1989 Bozzio et al. ..... 84/746
4,819,536 A * 4/1989 Lombardi ..... 84/746
4,908,905 A * 3/1990 Kanno et al. ..... 16/82
4,993,863 A * 2/1991 Inoue ..... 403/133
D338,483 S * 8/1993 Kurosaki ..... D17/22
5,368,525 A * 11/1994 Funahashi ..... 474/190
5,425,286 A * 6/1995 Laue ..... 74/560
5,627,332 A * 5/1997 Lombardi ..... 84/422.1
6,002,076 A * 12/1999 Karn ..... 84/422.1
7,045,701 B1 * 5/2006 Walker et al. ..... 84/746
7,147,498 B1 * 12/2006 Gillespie et al. ..... 439/260
2004/0025299 A1 * 2/2004 Higano et al. ..... 16/342

* cited by examiner

*Primary Examiner*—Jeffrey Donels
*Assistant Examiner*—Kawing Chan
(74) *Attorney, Agent, or Firm*—Foley & Lardner LLP

(57) ABSTRACT

A pedal system and method for a musical instrument includes a supporting pedestal operatively connected to a foot pedal such that the foot pedal is pivotal to allow a user to control a musical tone in conformance with the angle of the foot pedal relative to the supporting pedestal. A rotating section is operatively connected to the foot pedal. A pressing member presses upon a contact surface of the rotating section. A leaf spring (or similar bias member) applies pressure on the pressing member causing it to press upon the contact surface of the rotating section. A pressing force adjusting structure to adjust the elastic force with which the leaf spring forces the pressing member upon the contact surface of the rotating section. The rotating section rotates about a central axis of rotation, and the rotating section rotates relative to the supporting pedestal. The rotating section has a contact surface parallel to the central axis of rotation.

32 Claims, 5 Drawing Sheets

FOOT VOLUME PEDAL SYSTEMS AND METHODS

CROSS-REFERENCE TO RELATED PATENT APPLICATIONS

Japan Priority Application 2005-286178, filed Sep. 30, 2005 including the specification, drawings, claims, and abstract, is incorporated by reference herein, and is a basis for a claim of priority.

BACKGROUND OF THE INVENTION

1. Field of the Invention

Embodiments of the present invention relate to a foot pedal system and method for a musical instrument that allows a user to control a musical tone by adjusting a rotation load in conformance with user demands while controlling both material costs and manufacturing costs.

2. Related Art

Pedal systems for musical instruments have allowed users to step on a foot pedal linked to a supporting pedestal such that the foot pedal is free to pivot. Doing so would change a potentiometer's resistance value, or open and close a shutter, which would affect the amount of light reaching a light sensing element, in conformance with the angle of the foot pedal relative to the supporting pedestal, which in turn controlled a musical tone output.

For example, in Japanese Utility Model Publication No. 2583233 (Patent Reference 1), a pedal system for an electronic musical instrument is disclosed with which the control of a musical tone is carried out in accordance with a treadle angle relative to a supporting pedestal. In the pedal system in Patent Reference 1, a clamped member disposed protruding from the treadle is held by a clamping member arranged on the supporting pedestal.

However, with the pedal system in Patent Reference 1, the clamped member held by the clamping member is composed of leaf springs and friction plates on both sides of the clamped member. The frictional force on the clamped member can be changed by adjusting the length of a coil spring set between a bolt and a nut.

Such a configuration poses a problem because there are a large number of components, which results in high material costs. Additionally, the large number of components complicates the structure, thus increasing manufacturing costs as well.

Embodiments of the present invention can solve the problems described above and relate to a pedal system and method for a musical instrument that allows a user to control a musical tone by adjusting a rotation load in conformance with the user's demands while controlling both material costs and manufacturing costs.

SUMMARY OF THE DISCLOSURE

A pedal system and method for a musical instrument in accordance with an embodiment of the present invention includes a supporting pedestal operatively connected to a foot pedal such that the foot pedal is free to pivot allowing a user to control a musical tone in conformance with the angle of the foot pedal relative to the supporting pedestal. A rotating section is operatively connected to the foot pedal. A pressing member presses upon a contact surface of the rotating section. A leaf spring (or similar bias member) applies pressure on the pressing member, causing the pressing member to press upon the contact surface of the rotating section. A pressing force adjusting structure is provided to adjust the elastic force with which the leaf spring forces the pressing member upon the contact surface of the rotating section. The rotating section rotates about a central axis of rotation, and the rotating section rotates relative to the supporting pedestal. The rotating section has a contact surface substantially parallel to the central axis of rotation.

According to an embodiment of the present invention, the rotating section may be made from a metal material, and the pressing member may be made from a resin material.

Using these materials together may be beneficial because the rotating section can move smoothly across the pressing member without producing any abnormal noises caused by friction between the pressing member and the rotating section. Whereas, for example, if the pressing member and the rotating section were both made of metal, the combination could produce a screeching noise.

According to an embodiment of the present invention, the pressing force adjusting structure comprises a threaded member that fastens the leaf spring and the supporting pedestal together. As a result the friction force produced between the pressing member and the contact surface can be adjusted by tightening or loosening the threaded member.

This can be beneficial because a rotation load that satisfies the user's needs can be applied to the system, so that the system operates according to the user's needs. In addition, this can be beneficial because a threaded member, such as a screw, bolt, or the like can be extremely cheap and easy to manufacture and install, which can reduce material costs and the manufacturing costs.

According to an embodiment of the present invention, the pressing member has a concave surface in contact with a portion of the contact surface of the rotating section. Because the contact surface of the rotating section and the concave surface of the pressing member are fixed only by the elastic force applied by the leaf spring, the pressing member can be moved away from the rotating section by merely loosening the threaded member, which weakens the force exerted by the leaf spring.

This can be beneficial because the pressing member can be interchanged with other bias members made from various materials with different elastic coefficients. As a result, the pedal system can be configured to accommodate a variety of users.

According to an embodiment of the present invention, the cross-section shape of the contact surface of the rotating section perpendicular to the central axis of rotation is round. As a result, the distance between the central axis of rotation and pressing member does not change even as the angle of the foot pedal changes relative to the supporting pedestal. In other words, there is no restorative force if a round cross-section shape is used. Without a restorative force to revert the rotating section to its original state, the friction force applied by the pressing member to the rotating section can maintain the current state of the rotating section, even after operation of the foot pedal has ceased.

According to another embodiment of the present invention, the cross-section shape of the contact surface of the rotating section perpendicular to the central axis of rotation is oval. As a result, when the angle of the foot pedal relative to the supporting pedestal changes, the distance between the central axis of rotation and the pressing member changes according to the change of the angle of the foot pedal relative to the supporting pedestal. In other words, there may be a slight restorative force present. As a result, the user can easily return the foot pedal to its original state with just a small amount of force.

According to yet another embodiment of the present invention, the contact surface of the rotating section is flat and parallel to the central axis of rotation, the pressing member has a plane surface, and the plane surface of the pressing member contacts the flat surface of the rotating section. Therefore, when the angle of the foot pedal relative to the supporting pedestal changes, the distance between the central axis of rotation and the pressing member changes according to the change of the angle of the foot pedal relative to the supporting pedestal. Thus, even if the angle between the foot pedal and the supporting pedestal changes, the foot pedal can return to its original state automatically. In other words, because the rotating section's shape has a tendency to revert to its original position (i.e., the flat contact surface is level with the concave surface of the pressing member) when rotated, a restorative force is present.

According to an embodiment of the present invention, the contact surface of the rotating section may be coated with a plating of a selected material. This can be beneficial because the foot pedal will operate smoothly creating a smooth satisfactory feeling.

BRIEF DESCRIPTION OF THE DRAWINGS

FIG. 1(*b*) is an oblique view drawing of a pedal system for a musical instrument in accordance with an embodiment of the present invention;

FIG. 3(*b*) is a bottom view drawing of a pedal system for a musical instrument furnished with a bottom cover in accordance with an embodiment of the present invention;

FIG. 5(*b*) is an enlarged cross-section drawing of a pedal system for a musical instrument in accordance with a further embodiment of the present invention corresponding to a portion indicated by A in FIG. 2.

DETAILED DESCRIPTION OF PREFERRED EMBODIMENTS

Reference will now be made to the accompanying drawings, which assist in illustrating various pertinent features of embodiments of the present invention. FIG. 1(*a*) is a bottom view drawing of a pedal system for a musical instrument 1 according to an embodiment of the present invention. FIG. 1(*b*) is an oblique view drawing of the pedal system for a musical instrument 1 according to an embodiment of the present invention. In addition, FIG. 2 is a cross-section drawing of the pedal system for a musical instrument 1 of FIG. 1(*a*) along the line II-II.

Figure 1A:
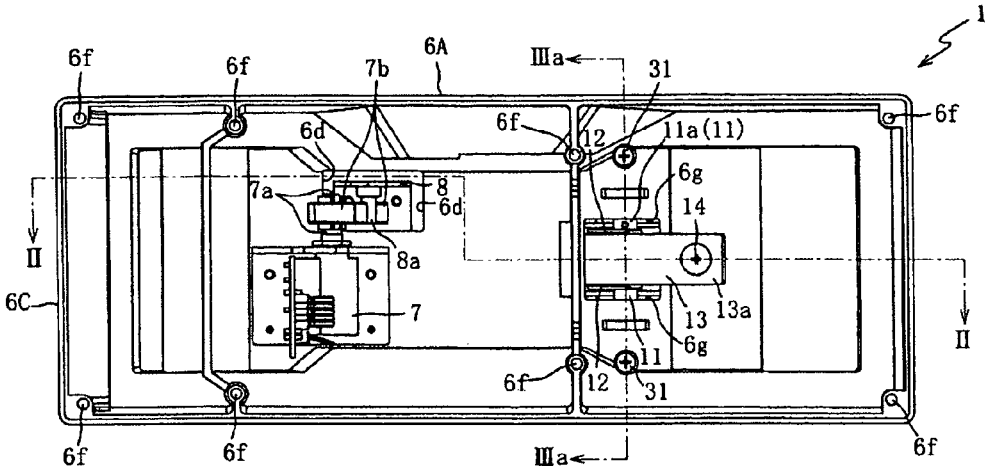
FIG. 1(*a*) is a bottom view drawing of a pedal system for a musical instrument in accordance with an embodiment of the present invention.
Figure 1B:
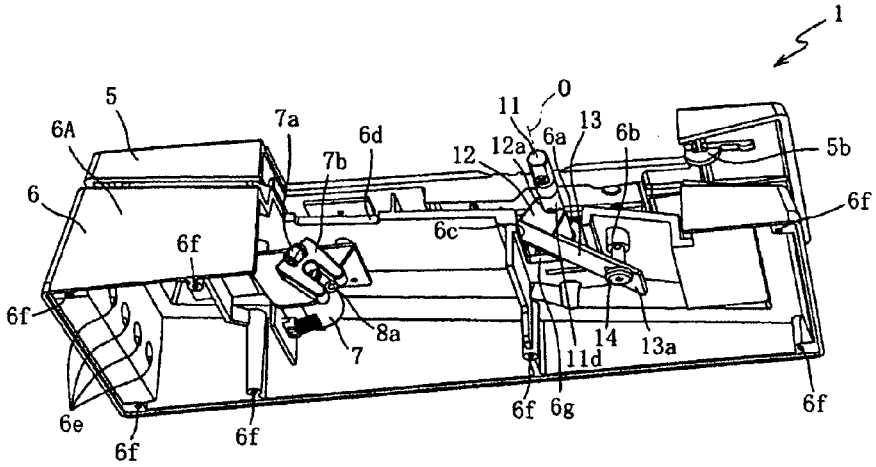
Figure 2:
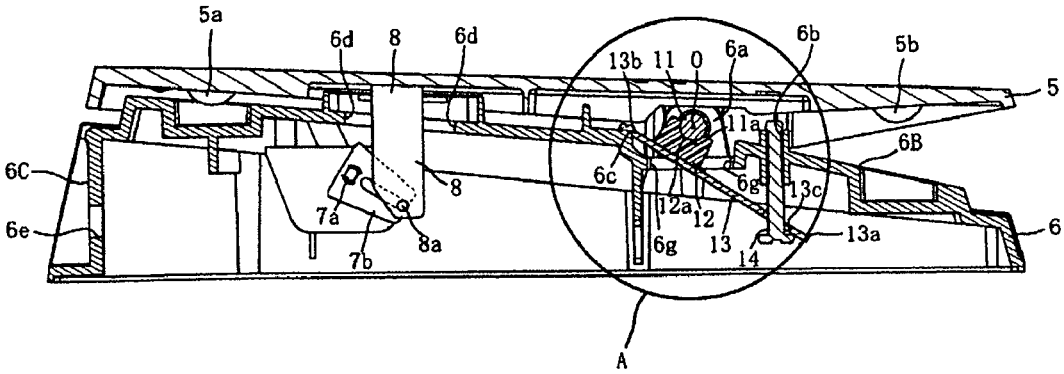
FIG. 2 is a cross-section drawing of a pedal system for a musical instrument in accordance with an embodiment of the present invention along a line II-II of FIG. 1(*a*)

As shown in FIG. 1(*a*), FIG. 1(*b*) and FIG. 2, the pedal system for a musical instrument 1 according to an embodiment of the present invention comprises a base or "supporting pedestal" 6, which is a hollow trapezoidal structure, a pivoting member or "foot pedal" 5, which is attached and arranged above the supporting pedestal 6, and a bottom cover 4, which covers the bottom surface of the supporting pedestal 6.

The supporting pedestal 6 comprises a front side surface 6C, three side surfaces 6A, and a top surface 6B, which together form a hollow trapezoidal structure. The supporting pedestal 6 may be made of a metal, such as die cast aluminum or the like. A first hole section 6*d* and a second hole section 6*g*, which are rectangular holes, are located on the top surface 6B of the supporting pedestal 6. In addition, a plurality of threaded holes 6*f* for attaching the bottom cover 4 are located on the four-sided surface bottom portion of the supporting pedestal 6.

A variable resistor 7 is attached to the supporting pedestal 6, below the first hole section 6*d*. The variable resistor 7 is capable of rotating and is operatively connected to a rotating shaft 7*a* such that the shaft section 7*a* is substantially parallel to a rotating shaft 11 having an axial dimension (discussed later) located within the foot pedal 5.

A "U" shaped pinching section 7*b* capable of grasping a shaft is attached to an end of the shaft section 7*a*.

As shown in FIG. 2, a plate 8 hangs downward from the foot pedal 5, passing through the first hole section 6*d*. A shaft 8*a* is operatively connected to the plate 8 wherein the shaft 8*a* is grasped by the pinching section 7*b*. The plate 8 rotates in conformance with the pivoting of the foot pedal 5. The plate 8 then causes the shaft section 7*a* of the variable resistor 7 to rotate, which changes the resistance value of the variable resistor 7.

A plurality of jack openings or ports 6*e*, which are round holes, are located on the front side surface 6C of the supporting pedestal 6. A jack for input (not shown) is mounted in the jack openings 6*e* and connected to an input terminal of the variable resistor 7. Meanwhile, a jack for output (not shown) is mounted in the jack openings 6*e* and connected to an output terminal of the variable resistor 7. Accordingly, an output plug of an electric guitar or the like can be inserted in the jack for input and a plug connected to an amplifier can be inserted in the jack for output. The user can then adjust the magnitude of the sound the amplifier outputs.

The foot pedal 5 may be a rectangular plate that is operatively connected to the top surface 6B of the supporting pedestal 6 and may be made of a metal, such as die cast aluminum or the like. A rubber layer pad (not shown) having a specified thickness may be affixed to the top surface of the foot pedal 5, to prevent slipping when the foot pedal 5 is operated.

A front semicircular regulating section 5*a* and a rear semicircular regulating section 5*b* regulate the pivoting range of the foot pedal 5. The front semicircular regulating section 5*a* and the rear semicircular regulating section 5*b* are respectively located on the front and rear ends of the foot pedal 5, on the side facing the supporting pedestal 6.

Figure 3:
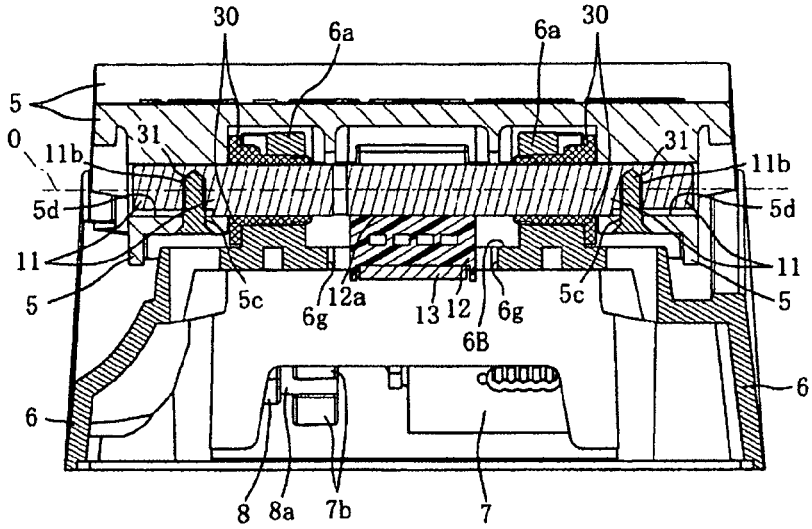
FIG. 3(*a*) is a cross-section drawing of a pedal system for a musical instrument in accordance with an embodiment of the present invention along a line IIIa-IIIa of FIG. 1(*a*)
Figure 3:
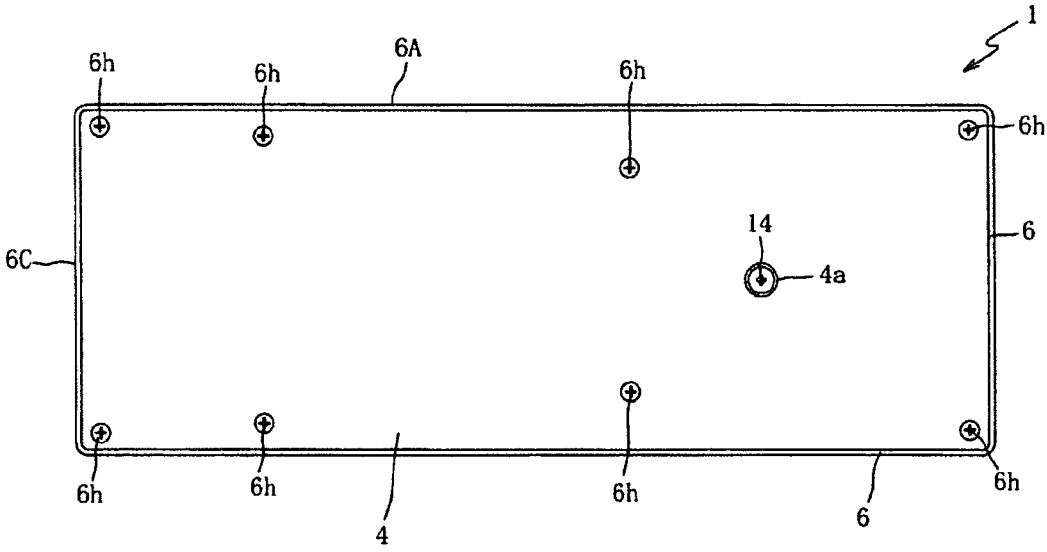

The rotating shaft 11 is operatively connected to the foot pedal 5, and the rotating shaft 11 is supported by bushings 30 (refer to FIG. 3(*a*)), which are bearings attached to the supporting pedestal 6, such that the rotating shaft 11 can rotate freely when the foot pedal 5 is operated. Moreover, according to an embodiment of the present invention, the bushings 30 may be made from polyethylene (PE) or the like.

Next, an explanation will be given regarding an example of a pressing section that applies a friction force to the rotating, shaft 11. An example pressing section comprises a pressing member 12, leaf spring 13 (or a similar bias member), and a threaded member 14, such as a screw, bolt, or the like.

The pressing member 12 may be a roughly rectangular parallelepiped and may be made of a resin material such as, for example, polypropylene (PP) or the like. The top surface of the pressing member 12 is a concave surface 12*a* that is roughly semicircular. The concave surface 12*a* runs along and presses upon the contact surface 11*a* of the rotating shaft 11, such that the rotating shaft 11 fits into the concave surface 12*a*. In addition, the bottom portion of the pressing member 12 is in contact with the leaf spring 13 and shaped to straddle the leaf spring 13 (refer to FIG. 3(*a*)). This contact portion is not connected to the leaf spring 13. Although the pressing member 12 is not connected to the leaf spring 13, the pressing member 12 is held between the rotating shaft 11 and the leaf spring 13. The leaf spring 13 applies an elastic force upon the pressing member 12 toward the rotating shaft 11, causing the concave surface 12*a* of the pressing member 12 to press against the contact surface 11*a* of rotating shaft 11, which applies a friction force to the rotating shaft 11.

The leaf spring 13 may be a plate-shaped spring having a strong elastic force and may be made of any suitable spring material including, but not limited to, steel or the like. The threaded member 14 is inserted through a latching hole 13*c* located on an end section 13*a* of the leaf spring 13 and fit into a female threaded hole 6*b* located on the supporting pedestal 6 that extends downward toward the bottom surface of the supporting pedestal 6. By tightening the threaded member 14, the head of the threaded member 14 presses on the end section 13*a* of the leaf spring 13, which increases the force applied upon the pressing member 12, which in turn increases the friction force applied upon the contact surface 11*a* of the rotating shaft 11.

An end section 13*b* of the leaf spring 13, which is opposite to the end section 13*a*, is curved to conform to an edge section 6*c* and is secured against the edge section 6*c*, which is an edge of the top surface 6B of the second hole section 6*g* on the supporting pedestal 6. Therefore, the leaf spring 13 applies pressure upon the pressing member 12 toward the contact surface 11*a* of the rotating shaft 11 with the edge section 6*c* acting as a pivot point, the end section 13*a* secured by the threaded member 14 acting as a point of force, and the pressing member 12 acting as the working area.

FIG. 3(*a*) is a cross-section drawing of a pedal system for a musical instrument 1 in accordance with an embodiment of the present invention along a line IIIa-IIIa of FIG. 1*a*.

As shown in FIG. 3(*a*), a fitting section 6*a* attached to the top surface 6B of the supporting pedestal 6 projects upward toward the foot pedal 5, such that the turning section 6*a* partially envelops the rotating shaft 11. The fitting section 6*a* is located between both sides of the second hold section 6*g*. The bushings 30, which are located between the rotating shaft 11 and the turning section 6*a*, support the rotating shaft 11 such that the rotating shaft 11 is free to rotate.

Feed-through holes 5*d* that project downward from the foot pedal 5 secure the rotating shaft 11 at each end. Two latching holes 5*c*, through which screws 31 are inserted, located on the supporting pedestal 6 side of the feed-through holes 5*d* project upward toward the foot pedal 5. In addition, the rotating shaft 11 contains two female threaded holes 11*b* that correspond to the latching holes 5*c*. The rotating shaft 11 is fastened to the foot pedal 5 by inserting the screws 31 through the latching holes 5*c* into the female threaded holes 11*b*.

According to an embodiment of the present invention the rotating shaft 11 may be made of a metal material or the like.

According to an embodiment of the present invention the rotating shaft 11 may be coated with a plating of a selected material, such as nickel plating, chrome plating, or the like.

FIG. 3(*b*) is a bottom view drawing of the pedal system 1 with the bottom cover 4 attached to the bottom surface of the supporting pedestal 6. Small fasteners 6*h*, such as screws, bolts, or the like are used to attach the bottom cover 4 to the supporting pedestal 6. A small hole 4*a* located on the bottom cover 4 is positioned to correspond to the threaded member 14, which may be used to adjust the amount of elastic force applied by the leaf spring 13 upon the pressing member 12, which corresponds to the friction applied upon the rotating shaft 11.

Therefore, the user can insert a screwdriver, ratchet, wrench, Allen wrench, or the like into the small hole 4*a* and tighten or loosen the threaded member 14. As a result, the friction force applied to the rotating shaft 11 can be adjusted easily without removing the bottom cover 4.

In addition, the user can insert a screwdriver, ratchet, wrench, Allen wrench, or the like into the small hole 4*a* located on the bottom cover 4 of the supporting pedestal 6 and easily adjust the friction force produced between the contact surface 11*a* of the rotating shaft 11 and the pressing member 12 by tightening or loosening the threaded member 14. As a result, a user can apply a load to the pivoting of the foot pedal 5 relative to the supporting pedestal 6 in conformance with the user's requirements.

As explained above, according to an embodiment of the present invention, when the user operates the foot pedal 5, the angle of the foot pedal 5 relative to the supporting pedestal 6 changes. This change causes the height of the plate 8 attached to the foot pedal 5 to change which then causes the electrical resistance of the variable resistor 7 to change accordingly. As a result the magnitude of sound outputted by an attached amplifier, for example, can be adjusted by operating the foot pedal 5.

In addition, according to an embodiment of the present invention, the pedal system for a musical instrument 1 can be extremely simple and can contain a small number of components, thus reducing the associated materials costs. Furthermore, because the structure can be simplified by the reduced number of components, the manufacturing costs are likewise reduced.

The cross-section shape of the contact surface 11*a* of the rotating shaft 11 perpendicular to the central axis of rotation 0 is round. Therefore, the distance between the central axis of rotation 0 and pressing member 12 does not change even as the angle of the foot pedal 5 changes relative to the supporting pedestal 6. In other words, there is no restorative force present. Without a restorative force to revert the rotating shaft 11 to its original state, the friction force applied by the pressing member 12 to the rotating shaft 11 can maintain the current state of the rotating shaft 11, even after operation of the foot pedal 5 has ceased.

In addition, the rotating shaft 11 can rotate silently in accordance with certain embodiments in which the rotating shaft 11 is made of a metal material, for example, steel, while the pressing member 12 is made of a resin material. Likewise, in embodiments in which the rotating shaft 11 is coated with a plating of a selected material, such as nickel plating, chrome plating, or the like, it is possible for the contact surface 11*a* of the rotating shaft 11 to slide smoothly across the concave surface 12*a* of the pressing member 12.

In addition, in embodiments in which the contact surface 11*a* of the rotating shaft 11 and the concave surface 12*a* of the pressing member 12 are fixed only by the force applied by the leaf spring 13, the pressing member 12 can be moved away from the rotating shaft 11 by merely loosening the threaded member 14, which weakens the elastic force exerted by the leaf spring 13. As a result, because the pressing member 12 and the rotating shaft 11 can be made from a variety of materials having different friction coefficients, the range of friction coefficients between the contact surface 11*a* of the rotating shaft 11 and the pressing member 12 can be made broad to accommodate a variety of users.

Figure 4:
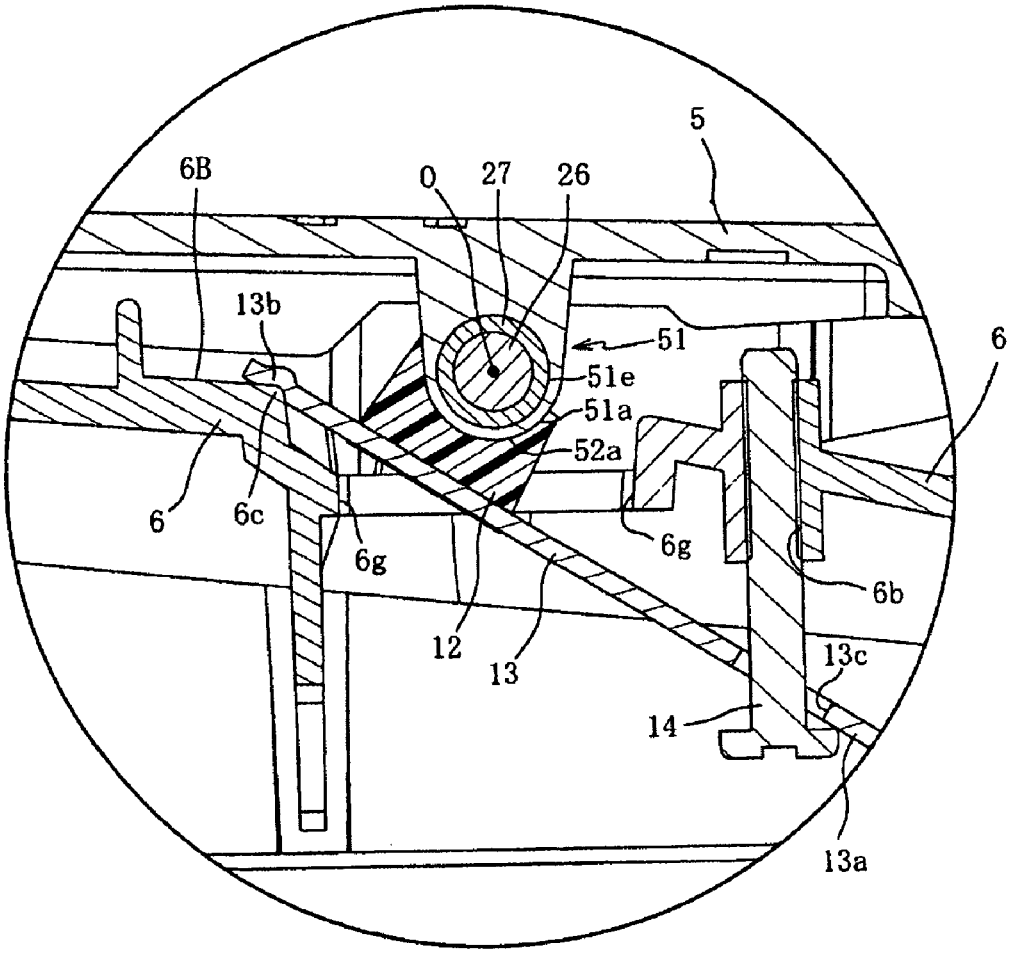
FIG. 4 is an enlarged cross-section drawing of a pedal system for a musical instrument in accordance with another embodiment of the present invention corresponding to a portion indicated by A in FIG. 2.

Another embodiment of the present invention is described in relation to the pedal system for a musical instrument 1 of FIG. 4. FIG. 4 is an enlarged cross-section drawing of a pedal system for a musical instrument 1 in accordance with an embodiment of the present invention corresponding to a portion indicated by A in FIG. 2. The configuration in FIG. 4 is the same as that of the pedal system for a musical instrument 1 discussed above, where the same reference characters have been assigned.

In the embodiment of FIG. 4, a shaft 26 is fastened to the supporting pedestal 6. Bearings (not shown) that retain the shaft 26 are fastened to the foot pedal 5. When the foot pedal 5 is operated, the foot pedal 5 rotates about the shaft 26. Whereas in the previous embodiment of the present invention, the rotating shaft 11, which is operatively connected to the foot pedal 5 and retained by the bushings 30 fastened to the supporting pedestal 6, rotates when the foot pedal 5 is operated.

As shown in FIG. 4, a turning section 51 is located above the rectangular shaped second hole section 6*g* on the supporting pedestal 6, such that the central axis of rotation 0, which is the axis the turning section 51 rotates about, is perpendicular to the lengthwise dimension of the foot pedal 5.

The turning section 51 projects downward from the foot pedal 5 and has a shaft hole 51*e* fitted with a roller bearing 27. The shaft 26 is fit into the roller bearing 27. The shaft 26 is fastened by screws (not shown) or the like to a non-rotating bearing (not shown) located on the supporting pedestal 6. As a result, the shaft 26 does not rotate. Therefore, when the user operates the foot pedal 5 and changes the angle of foot pedal 5 relative to the supporting pedestal 6, the foot pedal 5 rotates about the shaft 26 relative to the supporting pedestal 6.

A cylindrical shaped contact surface 51*a* is located on the bottom portion of the turning section 51, and is parallel to the central axis of rotation 0. In addition, a concave surface 52*a*, which runs along and contacts the contact surface 51*a* of the turning section 51, is located on the top surface of the pressing member 12. The leaf spring 13 applies an elastic force upon the pressing member 12 and brings the concave section 52*a* in contact with the contact surface 51*a* of the turning section 51 applying a friction force upon the turning section 51.

Because the elastic force can be adjusted as discussed above, it can be possible to adjust the friction force produced between the pressing member 12 and the contact surface 51*a* of the turning section 51. Therefore, a rotation load can be applied to the rotation between the supporting pedestal 6 and the foot pedal 5, allowing the user to adjust the rotation load in conformance with the user's requirements.

Figure 5:
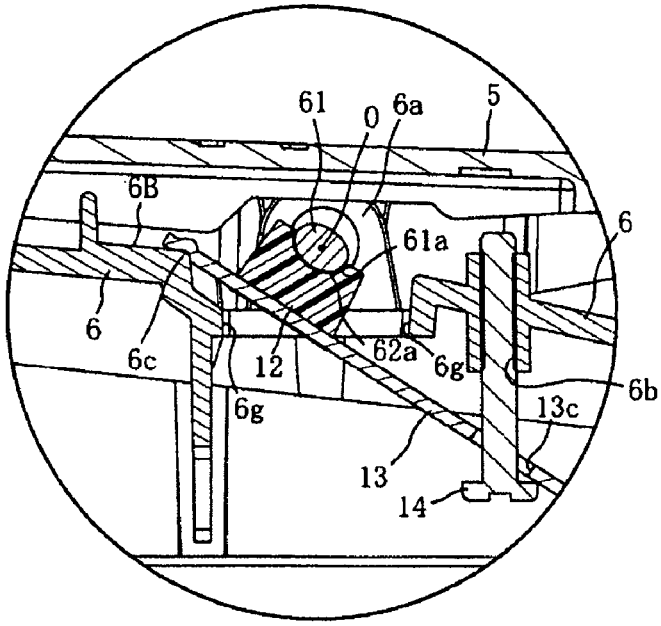
FIG. 5(*a*) is an enlarged cross-section drawing of a pedal system for a musical instrument in accordance with yet another embodiment of the present invention corresponding to a portion indicated by A in FIG. 2.
Figure 5:
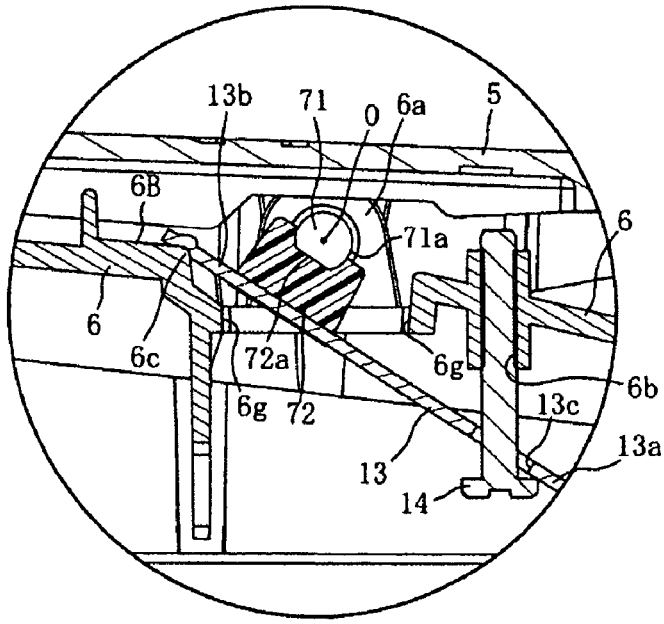

Yet another embodiment of a pedal system for a musical instrument 1 of the present invention is described in relation to FIG. 5(*a*). FIG. 5(*a*) is an enlarged cross-section drawing of a pedal system for a musical instrument I in accordance with an embodiment of the present invention corresponding to a portion indicated by A in FIG. 2. In this embodiment, the cross-section shape of the contact surface 11*a* of the rotating shaft 11 perpendicular to the central axis of rotation 0 is oval. Whereas in previous embodiments of the present invention, the cross- section shape of the contact surface 11*a* of the rotating shaft 11 is round.

As shown in FIG. 5(*a*), a rotating shaft 61, which has a cross-section shape that is an oval, is operatively connected to the foot pedal 5 in the same manner as previous embodiments of the present invention. The rotating shaft 61 is retained by the bushings 30, which are bearings located on the supporting pedestal 6 (refer to FIG. 3), such that the rotating shaft 61 is free to rotate.

The cross-section shape of a contact surface 61*a* of the rotating shaft 61 perpendicular to the central axis of rotation 0 is oval. In addition, a roughly semicircular concave surface 62*a* is located on the surface of the pressing member 12 running along and in contact with the contact surface 61*a* on the rotating shaft 61, such that the rotating shaft 61 fits into the concave surface 62*a* when the widest span of the rotating shaft 61 is parallel to the central axis of rotation 0. The leaf spring 13 applies an elastic force upon the pressing member 12 and brings the concave section 62*a* in contact with the contact surface 61*a* of the rotating shaft 61 applying a friction force to the rotating shaft 61.

Because the elastic force exerted by the leaf spring 13 can be adjusted as discussed above, the friction force produced between the pressing member 12 and the contact surface 61*a* of the rotating shaft 61 can be adjusted without removing the cover 4. Therefore, a rotation load can be applied to the rotation between the supporting pedestal 6 and the foot pedal 5, allowing the user to adjust the rotation load in conformance with the user's requirements.

In addition, for embodiments in which the cross-section shape of the contact surface 61*a* of the rotating shaft is oval, when the angle of the foot pedal 5 relative to the supporting pedestal 6 changes, the distance between the central axis of rotation 0 and the pressing member 12 changes according to the angle of the foot pedal 5 relative to the supporting pedestal 6. In other words, there may be a slight restorative force present. As a result, the user can easily return the state of the foot pedal 5 to its original state with just a small amount of force.

A further embodiment of a pedal system for a musical instrument 1 of the present invention is described in relation to FIG. 5(*b*). FIG. 5(*b*) is an enlarged cross-section drawing of a pedal system for a musical instrument 1 in accordance with an embodiment of the present invention corresponding to a portion indicated by A in FIG. 2. In this embodiment, the contact surface 11*a* of the rotating shaft 11 is flat and parallel to the central axis of rotation 0 of contact surface 11*a* of the rotating shaft 11.

As is shown in FIG. 5(*b*), a rotating shaft 71 is fastened to the foot pedal 5 as in previous embodiments of the present invention, and is retained by the bushings 30, which are bearings located on the supporting pedestal 6 (refer to FIG. 3), such that the rotating shaft 71 is free to rotate. In addition, a contact surface 71*a* on the rotating shaft 71, which is parallel to the central axis of rotation 0, is an even flat surface.

In addition, a concave surface 72*a* is located on the top surface of a pressing member 72. The concave surface 72*a* runs along and in contact with the contact surface 71*a* of the rotating shaft 71. The concave surface 72*a* may be furnished with a level plane surface, such that the flat contact surface 71*a* of the rotating shaft 71 fits into the concave surface 72*a*. The leaf spring 13 applies an elastic force upon the pressing member 72 and brings the concave section 72*a* in contact with the contact surface 71*a* of the rotating shaft 71 applying a friction force to the rotating shaft 71.

Therefore, when the angle of the foot pedal 5 relative to the supporting pedestal changes, the distance between the central axis of rotation 0 and the pressing member 72 increases according to the angle of the foot pedal 5 relative to the supporting pedestal 6 prior to the change. Therefore, even if the angle between the foot pedal 5 and the supporting pedestal 6 is changed, the rotating shaft 71 can revert to its original state automatically. In other words, a restorative force may be present because the rotating shaft 71—due to its shape—has a tendency to revert to its original position (i.e., the flat contact surface 71*a* is level with the concave surface 72*a* of the pressing member 12).

An explanation was given above according to some embodiments of the present invention, but the present invention is not in any way limited to the embodiments discussed above and the possibility of various modifications and changes that do not diverge from and are within the scope of the purpose of the present invention can be easily surmised.

For example, according to embodiments of the present invention described above, the resin material of the pressing member 12 may be made of PP. However, it may also be made of polyoxymethylene (polyacetal) (POM), PE, or the like. In this case, the rotation load can be reduced because the friction resistance is less than if PP is used as the resin material. Alternatively or additionally, acrylonitrile-butadiene-styrene (ABS) may also be used. In this case, the rotation load can be increased because the friction resistance is greater than if PP is used as the resin material.

In addition, a lubricating agent such as grease or the like can be applied between the pressing member 12 and the contact surface 11*a*. Alternatively or additionally, a resin material impregnated with grease or the like may also be used as the material for the pressing member 12. Likewise, in this case, a rotational load can be applied to the rotation between the supporting pedestal 6 and the foot pedal 5, allowing the user to adjust the rotational load in conformance with the user's requirements.

In addition, according to embodiments of the present invention, the resin material that composes the bushings 30 may be made of PE, but POM or the like may also be used to support the rotating shaft 11 so that the rotating shaft 11 is free to rotate.

What is claimed is:

1. A pedal system for a musical instrument, the pedal system comprising:

a supporting pedestal;

a foot pedal operatively connected to the supporting pedestal such that the foot pedal is pivotal to allow a user to control a musical tone in conformance with the angle of the foot pedal relative to the supporting pedestal;

a rotating section operatively connected to the foot pedal, the rotating section rotates about a central axis of rotation and relative to the supporting pedestal, and the rotating section has a contact surface substantially parallel to the central axis of rotation;

a pressing member that presses upon the contact surface of the rotating section;

a leaf spring that forces the pressing member to press upon the contact surface of the rotating section; and a pressing force adjusting structure to adjust an angle of the leaf spring;

wherein adjustment of the angle of the leaf spring adjusts the force the leaf spring applies upon the pressing member to press upon the contact surface of the rotating section.

2. The pedal system for a musical instrument of claim 1, wherein the rotating section is made from a metal material, and the pressing member is made from a resin material.

3. The pedal system for a musical instrument of claim 2, wherein the pressing member has a concave surface in contact with a portion of the contact surface of the rotating section.

4. The pedal system for a musical instrument of claim 2, wherein the cross-section shape of the contact surface of the rotating section perpendicular to the central axis of rotation is round.

5. The pedal system for a musical instrument of claim 2, wherein the cross-section shape of the contact surface of the rotating section perpendicular to the central axis of rotation is oval.

6. The pedal system for a musical instrument of claim 2, wherein the contact surface of the rotating section is flat and parallel to the central axis of rotation;

wherein the pressing member has a plane surface; and wherein the plane surface of the pressing member contacts the flat surface of the rotating section.

7. The pedal system for a musical instrument of claim 2, wherein the contact surface of the rotating section is coated with a plating.

8. The pedal system for a musical instrument of claim 1, wherein the pressing force adjusting structure is a threaded member that fastens the leaf spring and the supporting pedestal together.

9. The pedal system for a musical instrument of claim 1, wherein the pressing member has a concave surface in contact with a portion of the contact surface of the rotating section.

10. The pedal system for a musical instrument of claim 1, wherein the cross-section shape of the contact surface of the rotating section perpendicular to the central axis of rotation is round.

11. The pedal system for a musical instrument of claim 1, wherein the cross-section shape of the contact surface of the rotating section perpendicular to the central axis of rotation is oval.

12. The pedal system for a musical instrument of claim 1, wherein the contact surface of the rotating section is flat and parallel to the central axis of rotation;

wherein the pressing member has a plane surface; and wherein the plane surface of the pressing member contacts the flat surface of the rotating section.

13. The pedal system for a musical instrument of claim 1, wherein the contact surface of the rotating section is coated with a plating.

14. The pedal system for a musical instrument of claim 1, wherein the leaf spring is supported for pivotal movement; and wherein the pressing force adjustment structure is configured to cause the pivotal movement of the leaf spring.

15. The pedal system for a musical instrument of claim 14, wherein the leaf spring is supported for pivotal movement relative to the base.

16. The pedal system for a musical instrument of claim 1, the rotating section having an axial dimension and supported for rotation about its axis at at least one support location on its axial dimension, wherein the pressing member operatively engages the rotating section at a location laterally spaced along the axial dimension relative to the at least one support location.

17. A pedal system for a musical instrument, the pedal system comprising:

a base;

a pivoting member operatively connected to the base such that the pivoting member is pivotal to allow a user to control a sound in conformance with the angle of the pivoting member relative to the base, a rotating section operatively connected to the pivoting member, the rotating section supported for rotation about an axis of rotation relative to the base, the rotating section having a contact surface;

a friction member that applies friction to the contact surface of the rotating section;

a bias member that forces the friction member to press upon the contact surface of the rotating section, such that the rotating section rotates less as more friction is applied; and a pressing force adjusting structure to adjust an angle of the bias member;

wherein adjustment of the angle of the bias member adjusts the force the bias member applies upon the friction member to press upon the contact surface of the rotating section.

18. The pedal system for a musical instrument of claim 17, wherein the rotating section is made from a metal material, and the friction member is made from a resin material.

19. The pedal system for a musical instrument of claim 17, wherein the cross-section shape of the contact surface of the rotating section perpendicular to the central axis of rotation is round.

20. The pedal system for a musical instrument of claim 17, wherein the cross-section shape of the contact surface of the rotating section perpendicular to the central axis of rotation is oval.

21. The pedal system for a musical instrument of claim 17, wherein the contact surface of the rotating section is flat and parallel to the central axis of rotation;

wherein the friction member has a plane surface; and wherein the plane surface of the friction member contacts the flat surface of the rotating section.

22. The pedal system for a musical instrument of claim 17, wherein the contact surface of the rotating section is coated with a plating.

23. The pedal system for a musical instrument of claim 17, wherein the bias member comprises an elongated member, the elongated member having an angle relative to the base, the angle being adjustable by the pressing force adjustment structure.

24. The pedal system for a musical instrument of claim 23, wherein the elongated member is supported for pivotal movement; and wherein the pressing force adjustment structure is configured to cause the pivotal movement of the elongated member.

25. The pedal system for a musical instrument of claim 17, wherein the bias member comprises a leaf spring.

26. The pedal system for a musical instrument of claim 17, the rotating section having an axial dimension and supported for rotation about its axis at at least one support location on its axial dimension, wherein the friction member operatively engages the rotating section at a location laterally spaced along the axial dimension relative to the at least one support location.

27. A method for controlling a musical tone, comprising:

providing a base;

connecting a pivoting member to the base such that the pivoting member is pivotal to allow a user to control a sound in conformance with the angle of the pivoting member relative to the base as the pivoting member pivots;

connecting a rotating section to the pivoting member, the rotating section rotates about an axis of rotation relative to the base;

applying a friction force to a contact surface of the rotating section with a friction member that applies friction to the contact surface of the rotating section;

forcing the friction member to press upon the contact surface of the rotating section with a bias member, such that the rotating section rotates less as more friction is applied; and providing a pressing force adjusting structure to adjust an angle of the of the bias member;

wherein adjustment of the angle of the bias member adjusts the force the bias member applies on the friction member to press upon the contact surface of the rotating section.

28. The method of claim 27, wherein the rotating section is made from a metal material, and the friction member is made from a resin material.

29. The method of claim 27, wherein the contact surface of the rotating section is coated with a plating.

30. A pedal system for a musical instrument, the pedal system comprising:

a base;

a pivoting member operatively connected to the base such that the pivoting member is pivotal to allow a user to control a sound in conformance with the angle of the pivoting member relative to the base, a rotating section operatively connected to the pivoting member, the rotating section supported for rotation about an axis of rotation relative to the base, the rotating section having a contact surface;

a friction member that applies friction to the contact surface of the rotating section;

a bias member that forces the friction member to press upon the contact surface of the rotating section, such that the rotating section rotates less as more friction is applied; and a pressing force adjusting structure to adjust an angle of the bias member;

the rotating section having an axial dimension and supported for rotation about its axis at at least one support location on its axial dimension, wherein the friction member operatively engages the rotating section at a location laterally spaced along the axial dimension relative to the at least one support location.

31. The pedal system for a musical instrument of claim 30, wherein the bias member is supported for pivotal movement.

32. The pedal system for a musical instrument of claim 30, wherein the rotating section is supported at at least two support locations on its axial dimension; and wherein the pressing member contacts a point between the at least two support locations.

* * * * *